United States Patent [19]

Fifolt et al.

[11] Patent Number: 4,596,664

[45] **Date of Patent: * Jun. 24, 1986**

[54] NON-FLAMMABLE HYDRAULIC FLUIDS

[75] Inventors: Michael J. Fifolt, Grand Island; John Forcucci, Niagara Falls, both of N.Y.

[73] Assignee: Occidental Chemical Corporation, Niagra Falls, N.Y.

[ * ] Notice: The portion of the term of this patent subsequent to Jul. 9, 2002 has been disclaimed.

[21] Appl. No.: 691,986

[22] Filed: Jan. 16, 1985

Related U.S. Application Data

[63] Continuation-in-part of Ser. No. 519,940, Aug. 3, 1983, Pat. No. 4,528,109.

[51] Int. Cl.[4] ..... C10M 105/52; C10M 101/02; C10M 129/70; C10M 135/36

[52] U.S. Cl. ..... 252/75; 252/33; 252/33.6; 252/34; 252/39; 252/47; 252/56 R; 252/58; 252/77; 252/78.1

[58] Field of Search ..... 252/33, 33.6, 34, 39, 252/47, 56 R, 58, 75, 77, 78.1

[56] References Cited

U.S. PATENT DOCUMENTS

| | | | |
|---|---|---|---|
| 2,528,348 | 10/1950 | Denison, Jr. et al. | 252/78.1 |
| 2,583,588 | 1/1952 | Mosteller | 252/78.1 |
| 3,468,802 | 9/1969 | Nail | 252/75 |
| 3,492,233 | 1/1970 | Hepplewhite et al. | 252/73 |
| 3,775,319 | 11/1973 | Hartman | 252/75 |

FOREIGN PATENT DOCUMENTS

| | | | |
|---|---|---|---|
| 157188 | 9/1984 | Japan | 252/78.1 |

*Primary Examiner*—Paul Lieberman
*Assistant Examiner*—Robert A. Wax
*Attorney, Agent, or Firm*—James F. Tao; William G. Gosz

[57] ABSTRACT

Non-flammable hydraulic fluids which are particularly useful for replacing existing hydraulic fluids in hydraulic systems employing acrylonitrile-butadiene rubber and fluoroelastomer seals are disclosed. The non-flammable hydraulic fluids of the present invention comprise a fluorinated chlorotrifluoroethylene oil, a refined naphthenic oil, a phenolic antioxidant, a sulfur corrosion inhibitor, a metal deactivator, and an aliphatic ester. The fluorinated chlorotrifluoroethylene oil is present in an amount of at least about 75% by volume of the hydraulic fluid. In addition to being non-flammable, such hydraulic fluids are compatible with both the seals and brass components which contact the hydraulic fluid in hydraulic systems.

8 Claims, No Drawings

NON-FLAMMABLE HYDRAULIC FLUIDS

CROSS-REFERENCE TO RELATED APPLICATION

This is a continuation-in-part of application Ser. No. 519,940, filed Aug. 3, 1983, now U.S. Pat. No. 4,528,109.

BACKGROUND OF THE INVENTION

The present invention relates to improved hydraulic fluids useful in applications where the properties of existing hydraulic fluids present a significant fire hazard due to their inherent flammability. Typical applications for such non-flammable fluids include various civilian and military aircraft, tanks and transport vehicles in which hydraulic systems are subject to damage or failure resulting in leakage and ignition of the fluid.

Existing hyradulic fluids commonly used today in such applications are mineral, naphthenic, or synthetic oils which have been selected primarily on the basis of hydraulic properties without particular regard for non-flammability requirements. In fact, these fluids tend to be highly flammable and cannot be rendered non-flammable by the use of additives or special processing. Typical hydraulic oils which are used extensively in military vehicles are oils designated as MIL-H-6083 and MIL-H-46170.

Among the synthetic oils which have acceptable hydraulic properties, and which are also commercially available, are the chlorotrifluoroethylene-derived oils (hereinafter "CTFE" oils). These oils are essentially non-flammable due to their high degree of halogenation and can thus be used in hydraulic applications where the non-reactivity of the fluid is an essential requirement. CTFE oils are saturated, low molecular weight polymers (i.e. telomers) of chlorotrifluoroethylene, typically having from about 2 to about 10 repeating units in the telomer chain. The terminal groups of the telomer chain are generally derived from the catalyst and/or the solvent used in the telomerization process. The chemical and thermal stability of such CTFE oils is enhanced by fluorination of the terminal groups of the telomer.

A further requirement of hydraulic fluids is compatability with the particular sealing or gasket materials used in the hydraulic system. Sealing materials commonly used in such applications are generally in the form of O-rings fabricated from synthetic elastomers, such as acrylonitrile-butadiene rubber, fluoroelastomers, and the like. Frequently more than one type of elastomer is used in a hydraulic system for a particular piece of equipment. For example, various military hardware currently in use by the U.S. Army employ hydraulic seals fabricated from acrylonitrile-butadiene rubber, hereinafter "nitrile" rubber, and fluoroelastomeric seals such as Viton, a fluoroelastomer based on a copolymer of vinylidene fluoride and hexafluoropropylene manufactured and sold by the E. I. duPont de Nemours & Co., and PNF, a fluorophosphazene fluoroelastomer manufactured and sold by the Firestone Tire and Rubber Co.

In general, the seals for a particular piece of equipment are initially designed and selected on the basis of the specified hydraulic fluid. Thus, as would be expected, conventional hydraulic fluids used in such military hardware, i.e. MIL-H-6083 and MIL-H-46170, are compatible with seals of this type over an operating temperature range of from about −65° F. to about 250° F. However, the CTFE oils, although generally compatible with fluoroelastomers, have been found to be incompatible with nitrile rubber seals due to shrinkage and embrittlement of these seals in a relatively short period of time in the presence of CTFE oils. This shrinkage and embrittlement can result in leakage of fluid from the hydraulic line and consequent failure of the hydraulic circuit.

Elastomers employed as seals in hydraulic systems should swell slightly upon contact with the hydraulic fluid to provide a fluid-tight seal over the operating temperature range of the equipment. An acceptable range of swelling for purposes of this invention on the basis of percent relative volumetric expansion is generally from about 5% to about 15% over a temperature range of from about −65° F. to about 250° F. Of course, as implied from this statement, any shrinkage of the seal during operation of the hydraulic system cannot be tolerated since this will result in leakage of fluid from the system. Over-expansion of the seal and excessive softening will also lead to leakage of fluid.

It is also desirable for the seals to retain the same physical properties such as tensile and elongation strength after prolonged exposure to the hydraulic fluid. Therefore, the fluid should contain components which are capable of at least partial replacement of material extracted from the seals.

In addition to the foregoing, trace amounts of copper or copper-bearing metals such as naval brass from hydraulic system components can be present in the hydraulic fluid. The presence of even trace amounts of such metals can also cause hardening and embrittlement of the seals.

Commonly assigned copending application Ser. No. 519,940, filed Aug. 3, 1983, describes a non-flammable hydraulic fluid which is compatible with both nitrile rubber seals and fluoroelastomeric seals. This fluid comprises a fluorinated chlorotrifluoroethylene oil, an aliphatic ester, a liquid polyester or polyether, a dewaxed hydrocarbon oil, and a phenolic antioxidant. Unfortunately, however, this fluid will not prevent hardening and embrittlement of nitrile rubber seals in the presence of copper or copper-bearing metals.

Accordingly, it is a primary object of the present invention to provide a non-flammable hydraulic fluid which is compatible with both the seals and metal components used in hydraulic systems.

SUMMARY OF THE INVENTION

A non-flammable hydraulic fluid is provided for application in hydraulic systems having nitrile rubber and fluoroelastomer seals as well as brass components. Such a non-flammable fluid comprises at least about 75% by volume of a fluorinated chlorotrifluoroethylene oil, a refined naphthenic oil, a phenolic antioxidant, a sulfur corrosion inhibitor, a metal deactivator, and an aliphatic ester. The phenolic antioxidant retards oxidation of the seals and the hydrocarbon components of the fluid. The naphthenic oil is a cosolvent for the other fluid components and also acts as a plasticizer and swelling agent for the seals. The aliphatic ester is a swelling agent for the nitrile rubber seals and replaces seal components extracted by the hydraulic fluid. The sulfur corrosion inhibitor and metal deactivator function, respectively, to reduce metal corrosion due to the presence of sulfur and to passivate the surface of copper and copper-bearing metal system components.

The refined naphthenic oil is present in an amount of from about 5% to about 20% by volume of fluid, the aliphatic ester is present in an amount of from about 1% to about 15% by volume of fluid, the phenolic antioxidant is present in an amount of from about 0.01% to about 5% by weight of fluid, the sulfur corrosion inhibitor is present in an amount of from about 0.001% to about 1% by weight of fluid, and the metal deactivator is present in an amount of from about 0.005% to about 2% by weight of fluid.

DESCRIPTION OF THE PREFERRED EMBODIMENTS

The non-flammable hydraulic fluid of the present invention comprises a fluorinated CTFE oil, a refined naphthenic oil, a phenolic antioxidant, a sulfur corrosion inhibitor, a metal deactivator, and an aliphatic ester.

The CTFE oil is the major component of the fluid, comprising at least about 75% by volume of the formulated composition. Such CTFE oils can be prepared using a variety of techniques. A fluorinated CTFE oil which is suitable for use in this invention is commercially available in various grades from the Occidental Chemical Corporation as Fluorolube(®) oil.

The fluorinated CTFE oil is inherently non-flammable and is the only non-flammable component of the fluid. In order to preserve the overall non-flammable character of the fluid, and to meet user specifications, it has been found necessary to employ amounts of fluorinated CTFE oil of at least about 75% by volume of the fluid.

A refined naphthenic oil is needed as a cosolvent for the other components of the fluid and to plasticize and expand the seals. Naphthenic oils are preferred over paraffinic and aromatic oils. A typical naphthenic oil which is useful for this purpose is Exxon 3146 Oil which is manufactured and sold by the Exxon Corporation. Amounts of naphthenic oil in the range of from about 5% to about 20% by volume of fluid are generally suitable.

The phenolic antioxidant of the present invention is used to prevent oxidation of the seals as well as hydrocarbon components of the fluid. Phenols which are useful for this purpose include various alkylated phenols, hindered phenols and phenol derivatives such as t-butyl hydroquinone, butylated hydroxyanisole, polybutylated bisphenol A, butylated hydroxy toluene, alkylated hydroquinone, 2,6-ditert-butyl-para-cresol, 2,5-ditert-aryl hydroquinone, and the like. A preferred phenolic antioxidant is Irganox(®) L-130, a t-butyl phenol derivative manufactured and sold by the Ciba Geigy Co. Amounts of phenolic antioxidant in the range of from about 0.01% to about 5% by weight of fluid are acceptable. Phosphites can also be used in combination with the aforementioned phenolic antioxidants.

An aliphatic ester is incorporated in the fluid as a swelling agent for the nitrile rubber seals in the hydraulic circuit. The primary utility of this component is to prevent shrinkage of the nitrile rubber seals by replacing components of the seal which are extracted by the fluid. Preferred aliphatic esters are those having a low freeze point (i.e. less than about −40° C.). Particularly preferred are the adipate esters such as diisodecyl adipate, dioctyl adipate, diisobutyl adipate, di-(2-ethylhexyl) adipate, n-octyl adipate, n-decyl adipate, and alkoxy adipate esters such as dibutoxyethoxyethyl adipate, dibutoxyethyl adipate, dibutoxy adipate, and the like. Mixtures of the foregoing adipate esters can also be used. Particularly suitable adipate esters include Plasthall 7006, an alkyl alkylether diester adipate manufactured and sold by C. P. Hall Corp., and Thiokol TP-95, a dibutoxyethoxyethyl adipate manufactured and sold by the Thiokol Chemical Corp. Preferably, the adipate ester is present in an amount of from about 1% to about 15% by volume of fluid.

Surprisingly, aromatic esters have not been found to be as effective as aliphatic esters. For instance, phthalates, such as diisodecyl phthalate, contribute to the formation of a precipitate or sludge in the fluid and should therefore be avoided. Similarly, phosphate esters are not compatible with the nitrile rubber seals and should also be avoided.

The sulfur corrosion inhibitor functions to reduce the corrosion of copper and copper-bearing hydraulic system components due to the presence of sulfur and sulfur compounds in the hydraulic fluid. Suitable sulfur corrosion inhibitors include Amoco 158, an alkyl thiodiazol which is manufactured and sold by the Amoco Chemicals Corp., and Elco 461, which is manufactured and sold by the Elco Corporation. The sulfur corrosion inhibitor can be suitably present in an amount of from about 0.001% to about 1% by weight of fluid.

A metal deactivator is also incorporated in the hydraulic fluid. This component functions as a film-forming agent or complexing agent for copper or copper-bearing surfaces and acts to prevent further corrosion. A particularly preferred metal deactivator is du Pont DMD, an N,N-disalicylidene-1,2-propanediamine manufactured and sold by the E. I. du Pont de Nemours & Co. Other useful metal deactivators include Vanlube(®) 601, 691, 704, and 793, which are manufactured and sold by the R. T. Vanderbilt Co. Amounts of metal deactivator of from about 0.005% to about 2% by weight of fluid are suitable.

Other additives, such as rust inhibitors and lubricity enhancers, can also be incorporated in the hydraulic fluid. A particularly useful rust inhibitor which serves to inhibit ferrous metal corrosion is Nasul(®) BSN, a barium dinonylnaphthalene sulfonate manufactured and sold by the R. T. Vanderbilt Co. The rust inhibitor, if present, can be suitably present in an amount of from about 0.01% to about 5% by weight of fluid.

The formulated hydraulic fluid is prepared by blending the various additive components with the base stock fluid, i.e., the fluorinated CTFE oil, until a uniform mixture is obtained with no separation of the components. The order of addition of the components is not critical.

The following examples are intended to further illustrate the various embodiments and advantages of the present invention without limiting it thereby. Example 1 illustrates the effect of the formulated hydraulic fluid of this invention on nitrile rubber and fluoroelastomeric O-ring seals and naval brass strips using a static test simulation of an operational hydraulic system.

EXAMPLE 1

O-ring seals were placed in a jar containing sample fluid in a circulating air oven to simulate an actual hydraulic system. The sample fluid formulation contained the following ingredients in the relative proportions as indicated below:

80.0% (vol.) Fluorolube Oil
15.0% (vol.) Exxon 3146 Oil 5.0% (vol.) Plasthall 7006
1.0% (wt.) Irganox L-130
1.0% (wt.) Nasul BSN
0.25% (wt.) Du Pont DMD
0.05% (wt.) Amoco 158.

The manufacturer's designations for these additives have been previously defined elsewhere in the specification.

The O-rings were placed in the jar containing the fluid and covered to minimize exposure to air during the test. A naval brass strip (Alloy C-464) was also placed in the sample jar. The sample was tested in an oven at 225° F. for 72 hours. The O-rings were removed, dried and tested for hardness (using a Shore Durometer), tensile and elongation strength. The volume change was also measured, and the appearance of the seals was visually observed. Naval brass corrosion was determined by removing and cleaning the brass strip, and measuring the weight loss.

The results are set forth in Table I.

In the table seals A and B designate O-rings fabricated from sulfur-cured nitrile rubber and peroxide-cured nitrile rubber, respectively. Seal C designates an O-ring fabricated from Viton. The O-rings were approximately 1.25 inches in diameter (o.d.).

The original values of the elongation stress of O-rings from the same lot are set forth in parenthesis to the right of the corresponding values obtained after the test.

TABLE I

| Seal Type | Percent Volume Change | Percent Change in Hardness | Stress @ 100% Elongation (psi) | Percent Retention of Tensile @ Break | Percent Retention of Elongation @ Break | Percent Weight Loss of Naval Brass |
|---|---|---|---|---|---|---|
| A* | +7.4 | −0.7 | 859 (560) | 80 | 65 | 0.0060 |
| B* | +6.9 | −4.1 | 950 (758) | 85 | 81 | 0.0051 |
| C* | +20.9 | −11.0 | 701 (735) | 75 | 75 | 0.0068 |

*Represents the average of two tests.

As shown in the table, all seals had excellent physical property retention. The percent weight loss of the naval brass strip was negligible. The brass strips which were removed from the jars appeared slightly discolored but otherwise bright.

EXAMPLE 2

Following the procedure of Example 1, O-rings were tested for comparative purposes using the non-flammable hydraulic fluid formulation of copending commonly assigned application Ser. No. 519,940, filed Aug. 3, 1983, the disclosure of which is incorporated by reference herein. This formulation contained the following ingredients in the relative proportions as indicated below:

77.5% (vol.) Fluorolube Oil
15.0% (vol.) Sun 91 Golden Oil
5.75% (vol.) Thiokol TP-95
1.75% (vol.) Vulkanol FH
0.5% (wt.) Irganox L-130.

The results are set forth in Table II, with the seal types corresponding to those in Example 1.

TABLE II

| Seal Type | Percent Volume Change | Percent Change in Hardness | Stress @ 100% Elongation (psi) | Percent Retention of Tensile @ Break | Percent Retention of Elongation @ Break | Percent Weight Loss of Naval Brass |
|---|---|---|---|---|---|---|
| A | +11.3 | +16.4 | *(560) | 7 | 11 5 | 0.1182 |
| B | +19.1 | +4.0 | *(758) | 16 | 17 | 0.0354 |
| C | +26.4 | −11.0 | 655 (735) | 74 | 85 | 0.2510 |

*Samples did not reach 100% elongation.

As shown in the table, seals A and B experienced significant hardening and failed the elongation and tensile strength tests. The percent weight loss of the naval brass strip was also significant. The brass strips which were removed from the jars contained a black coating.

While various embodiments and exemplifications of this invention have been shown and described in the specification, modifications and variations thereof will be readily appreciated by those skilled in the art. It is to be understood, therefore, that the appended claims are intended to cover all such modifications and variations which are considered to be within the scope and spirit of the present invention.

What is claimed is:

1. A non-flammable hydraulic fluid comprising at least about 75% by volume of a fluorinated chlorotrifluoroethylene oil, from about 5% to about 20% by volume of a refined naphthenic oil, from about 0.01% to about 5% by weight of a phenolic antioxidant, from about 1% to about 15% by volume of an aliphatic ester, from about 0.001% to about 1% by weight of a sulfur corrosion inhibitor, and from about 0.005% to about 2% by weight of a metal deactivator.

2. The hydraulic fluid of claim 1 wherein the aliphatic ester has a freeze point of less than about −40° C.

3. The hydraulic fluid of claim 2 wherein the aliphatic ester is an adipate ester.

4. The hydraulic fluid of claim 1 wherein the metal deactivator comprises N,N-disalicylidene-1,2-propanediamine.

5. The hydraulic fluid of claim 1 wherein the sulfur corrosion inhibitor comprises an alkyl thiodiazol.

6. The hydraulic fluid of claim 1 which includes a rust inhibitor.

7. The hydraulic fluid of claim 6 wherein the rust inhibitor is present in an amount of from about 0.01% to about 5% by weight of fluid.

8. The hydraulic fluid of claim 7 wherein the rust inhibitor comprises a barium dinonylnaphthalene sulfonate.

* * * * *